US007288012B2

(12) United States Patent
Akiyama et al.

(10) Patent No.: US 7,288,012 B2
(45) Date of Patent: Oct. 30, 2007

(54) METHOD OF MANUFACTURING PLASMA DISPLAY PANEL

(75) Inventors: Koji Akiyama, Neyagawa (JP); Koji Aoto, Nishinomiya (JP); Masaaki Yamauchi, Takatsuki (JP); Takashi Aoki, Ibaraki (JP); Akihiro Matsuda, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 298 days.

(21) Appl. No.: 10/533,138

(22) PCT Filed: Jun. 17, 2004

(86) PCT No.: PCT/JP2004/008832

§ 371 (c)(1),
(2), (4) Date: Apr. 29, 2005

(87) PCT Pub. No.: WO2004/114349

PCT Pub. Date: Dec. 29, 2004

(65) Prior Publication Data

US 2006/0166585 A1 Jul. 27, 2006

(30) Foreign Application Priority Data

Jun. 18, 2003 (JP) ..... 2003-173206

(51) Int. Cl.
*H01J 9/00* (2006.01)
*H01J 9/44* (2006.01)

(52) U.S. Cl. ..... 445/6; 445/5; 315/169.1; 345/41; 345/42

(58) Field of Classification Search ..... None
See application file for complete search history.

(56) References Cited

U.S. PATENT DOCUMENTS 6,376,995 B1 * 4/2002 Kato et al. ..... 315/169.3
6,483,487 B2 * 11/2002 Iseki ..... 345/60
6,633,268 B2 * 10/2003 Kougami et al. ..... 345/60
6,666,738 B1 * 12/2003 Kado et al. ..... 445/6
6,731,275 B2 * 5/2004 Mizobata ..... 345/209
6,768,479 B2 * 7/2004 Nakamura ..... 345/60

(Continued)

FOREIGN PATENT DOCUMENTS

JP 7-226162 8/1995

(Continued)

*Primary Examiner*—Mariceli Santiago
(74) *Attorney, Agent, or Firm*—Wenderoth, Lind & Ponack, L.L.P.

(57) ABSTRACT

A plasma display panel is provided that includes scan electrodes, sustain electrodes, and address electrodes. A first pulse voltage for the address electrodes or a second pulse voltage for the address electrodes is applied to the address electrodes in an aging step in which aging discharge is performed by alternately applying pulse voltage for the scan electrodes and pulse voltage for the sustain electrodes at least across the scan electrodes and the sustain electrodes. The first pulse voltage has a rising edge timing synchronized with a rising edge timing of the pulse voltage for the scan electrodes and a pulse width smaller than that of the pulse voltage for the scan electrodes. The second pulse voltage has a rising edge timing synchronized with a rising edge timing of the pulse voltage for the sustain electrodes and a pulse width smaller than that of the pulse voltage for the sustain electrodes.

6 Claims, 10 Drawing Sheets

U.S. PATENT DOCUMENTS

2002/0008680 A1* 1/2002 Hashimoto et al. ..... 345/63
2003/0030377 A1* 2/2003 Hirano et al. ..... 313/587
2003/0141815 A1* 7/2003 Chung ..... 313/562
2003/0193453 A1* 10/2003 Mizobata ..... 345/60
2005/0012691 A1* 1/2005 Tokunaga et al. ..... 345/60
2006/0082522 A1* 4/2006 Kim et al. ..... 345/67

FOREIGN PATENT DOCUMENTS

JP 9-251841 9/1997
JP 2002-75210 3/2002
JP 2002-231141 8/2002

* cited by examiner

FIG. 6A
FIG. 6B
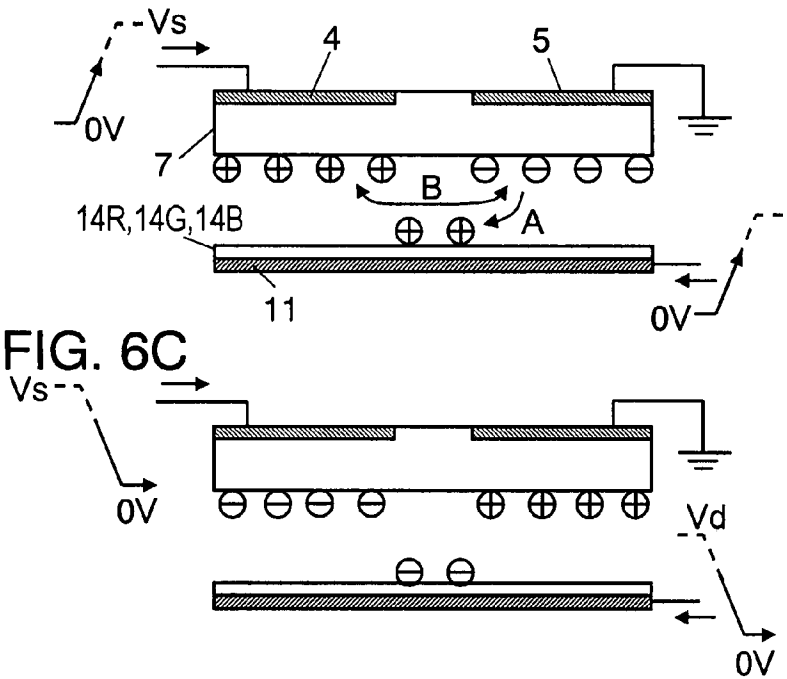
FIG. 6C
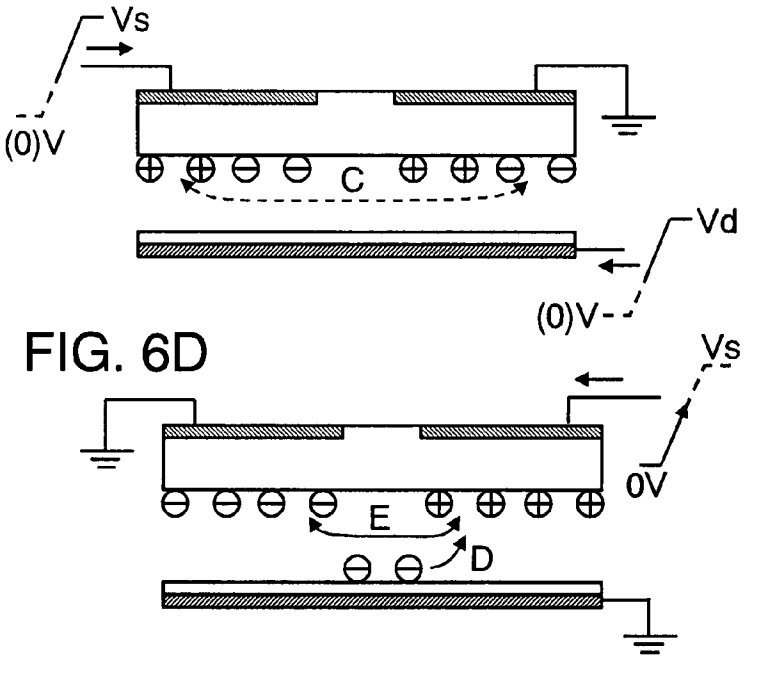
FIG. 6D
FIG. 6E
FIG. 6F

METHOD OF MANUFACTURING PLASMA DISPLAY PANEL

CROSS-REFERENCE TO RELATED APPLICATIONS

This application is a National Stage of International Application No. PCT/JP04/08832, filed Jun. 17, 2004.

BACKGROUND OF THE INVENTION

1. Field of the Invention

The present invention relates to a method of manufacturing a plasma display panel, which is known as a display device.

2. Description of the Related Art

A plasma display panel (hereinafter abbreviated as "PDP") is a display device having excellent visibility and featuring a large screen, flatness and light weight. The systems of discharging a PDP include an alternating-current (AC) type and direct-current (DC) type. The electrode structures thereof include a three-electrode surface-discharge type and an opposite-discharge type. Now, the current mainstream is an AC surface-discharge type PDP, because this type of PDP is suitable for higher definition and easy to manufacture.

Generally, an AC surface-discharge type PDP has a large number of discharge cells formed between a front panel and a rear panel faced with each other. In the front panel, a plurality of display electrodes, each made of a pair of scan electrode and sustain electrode, are formed on a front glass substrate in parallel with each other. A dielectric layer and a protective layer are formed to cover these display electrodes. In the rear panel, a plurality of parallel address electrodes is formed on a rear glass substrate. A dielectric layer is formed on the address electrodes to cover them. Further, a plurality of barrier ribs is formed on the dielectric layer in parallel with the address electrodes. Phosphor layers are formed on the surface of the dielectric layer and the side faces of the barrier ribs. Then, the front panel and the rear panel are faced with each other and hermetically joined, i.e. sealed, together so that the display electrodes and data electrodes are orthogonal to each other. Thereafter, a discharge gas is filled into a discharge space formed therebetween to form a PDP.

For a PDP fabricated as above, a voltage necessary for uniformly lighting the entire panel (hereinafter simply referred to as "operating voltage") is high, and discharge itself is unstable. These are because impure gases, such as $H_2O$, $CO_2$, and hydrocarbon gas, are adsorbed onto the surface of the protective layer formed of MgO. To solve this problem, a method of manufacturing a PDP includes an aging step in which sputtering caused by aging discharge removes these adsorbed gases. This step decreases the operating voltage and makes discharge characteristics uniform and stable.

As such, a method of aging including pulse voltage of rectangular waves in opposite phases has conventionally been applied across scan electrodes and sustain electrodes for a long period of time as alternating voltage. However, to shorten the aging time, another method is proposed (see Japanese Patent Unexamined Publication No. 2002-231141, for example). In this method, pulse voltage of rectangular waves in opposite phases is applied across display electrodes, and pulse voltage having a waveform in the same phase as the voltage waveform applied to sustain electrodes is also applied to address electrodes to cause discharge between the scan electrodes and sustain electrodes, and between the scan electrodes and the address electrodes.

However, even with this aging method, it takes approximately 10 hours until aging is completed, i.e. the operating voltage is decreased and discharge is stabilized. Such aging for a long period of time is one of the factors in huge power consumption and increases costs of manufacturing PDPs, the area of a factory site, and the facilities for maintaining the environment of the factory, such as air-conditioning equipment. It is also obvious that these problems become more serious as PDPs will have a larger screen and the amount of their production will increase in the future.

The present invention addresses these problems, and aims to achieve a method of manufacturing a PDP capable of reducing aging time and performing more power-efficient aging.

BRIEF SUMMARY OF THE INVENTION

To address these problems, a method of manufacturing a plasma display panel (PDP) including scan electrodes, sustain electrodes, and address electrodes, of the present invention includes the step of: applying to the address electrodes at least one of first pulse voltage for the address electrodes and second pulse voltage for the address electrodes, in an aging step in which aging discharge is performed by alternately applying pulse voltage for the scan electrodes and pulse voltage for the sustain electrodes at least across the scan electrodes and the sustain electrodes. The first pulse voltage for the address electrodes has a rising edge timing synchronized with a rising edge timing of the pulse voltage for the scan electrodes and a pulse width smaller than that of the pulse voltage for the scan electrodes. The second pulse voltage for the address electrode has a rising edge timing synchronized with a rising edge timing of the pulse voltage for the sustain electrodes and a pulse width smaller than that of the pulse voltage for the sustain electrodes.

BRIEF DESCRIPTION OF THE DRAWINGS

FIGS. 6A-6F are schematic drawings for predicting wall charges in a discharge cell of the PDP in the aging step in accordance with the exemplary embodiment.

DETAILED DESCRIPTION OF THE INVENTION

A method of manufacturing a plasma display panel (PDP) in accordance with an exemplary embodiment of the present invention is described hereinafter with reference to the accompanying drawings.

Figure 1:
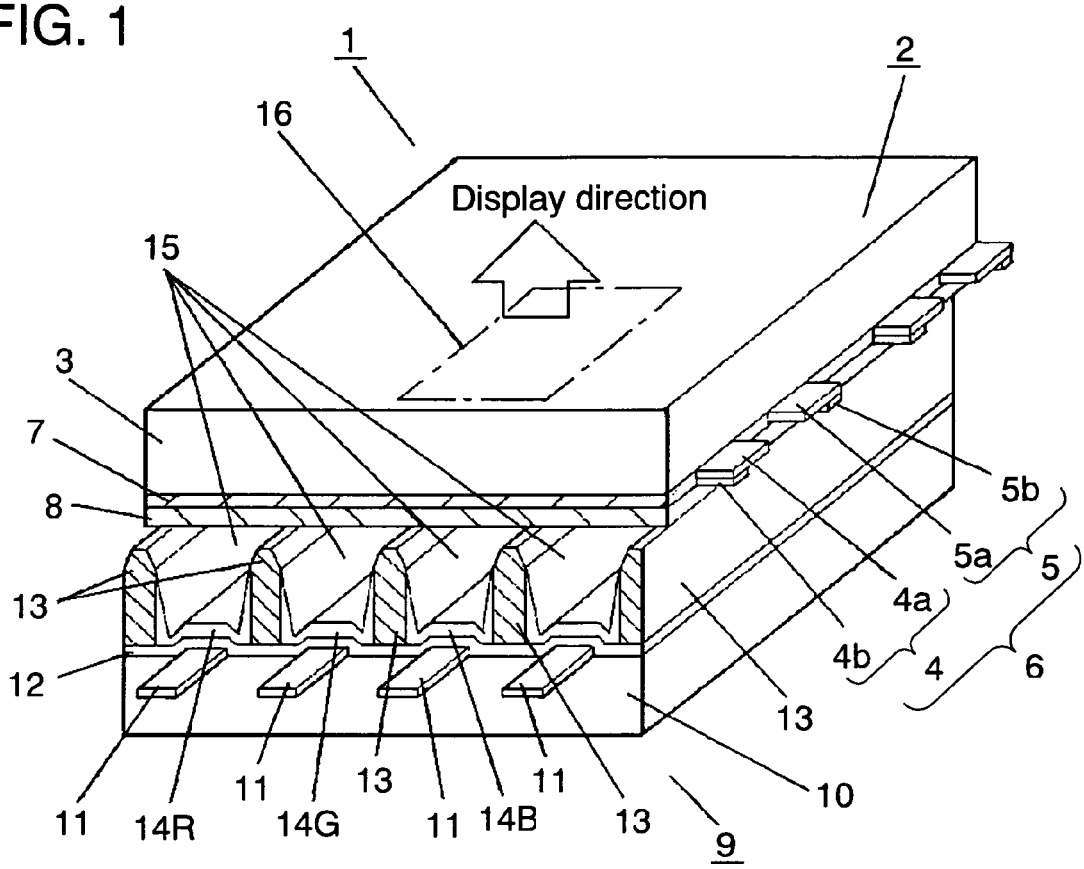
FIG. 1 is a sectional view in perspective showing a structure of a plasma display panel (PDP) manufactured by a method of manufacturing a PDP in accordance with an exemplary embodiment of the present invention.

FIG. 1 is a sectional view in perspective showing a structure of a PDP manufactured by a method of manufacturing a PDP in accordance with the exemplary embodiment of the present invention.

In front panel 2 of PDP 1, a plurality of display electrodes, each made of scan electrode 4 and sustain electrode 5, are formed on substrate 3 made of a glass or the like. Dielectric layer 7 made of low-melting glass material is formed to cover display electrodes 6. Further, protective layer 8 is formed on dielectric layer 7. Protective layer 8 is formed of MgO, for example, to protect dielectric layer 7 from damage caused by plasma. Each scan electrode 4 is formed of transparent electrode 4*a* and bus electrode 4*b* electrically connected to this transparent electrode 4*a*. Each sustain electrode 5 is formed of transparent electrode 5*a* and bus electrode 5*b* electrically connected to this transparent electrode 5*a*. Transparent electrodes 4*a* and 5*a* are discharge electrodes. Bus electrodes 4*b* and 5*b* are made of Cr-Cu-Cr, or Ag, for example.

In rear panel 9, a plurality of address electrodes 11 is formed on substrate 10 made of a glass or the like. Dielectric layer 12 is formed to cover address electrodes 11. In each position between adjacent address electrodes 11 on dielectric layer 12, barrier rib 13 is provided. On the surface of dielectric layer 12 and the side faces of barrier ribs 13, phosphor layers of respective colors of red (R), green (G), and blue (B) 14R, 14G, and 14B are provided.

Then, front panel 2 is faced with rear panel 9 sandwiching barrier ribs 13 so that display electrodes 6 are orthogonal to address electrodes 11 and a discharge space 15 is formed therebetween. In discharge space 15, at least one kind of rare gas including helium, neon, argon, and xenon is filled at a pressure of approximately 66,500 Pa (500 Torr). Each intersection of address electrode 11 and display electrode 6 is partitioned by barrier ribs 13 in this manner to form discharge cell 16. Further, discharge is caused by application of driving voltage to address electrodes 11 and display electrodes 6 in PDP 1. Ultraviolet rays generated at this time are converted into visible light by phosphor layers 14R, 14G, and 14B for image display.

Immediately after such a PDP is manufactured, its operating voltage is high, and discharge itself is unstable. This is because impure gases, such as $H_2O$, $CO_2$, and hydrocarbon gas, are adsorbed onto the surface of MgO, protective layer 8. Then, an aging step is performed to remove these adsorbed gases by sputtering caused by aging discharge (hereinafter simply referred to as "discharge"), decrease the operating voltage, and make discharge characteristics uniform and stable. In the aging step, predetermined pulse voltage is applied to display electrodes 6 and address electrodes 11 to cause discharge in discharge space 15. Now, because the entire panel must be lit, the pulse voltage is set at least to the operating voltage of the panel.

Hereinafter, a description is provided of an aging step in the method of manufacturing a PDP in accordance with the exemplary embodiment of the present invention. The steps of manufacturing PDP 1 other than the aging step are the same as conventional steps of manufacturing a PDP.

Figure 2:
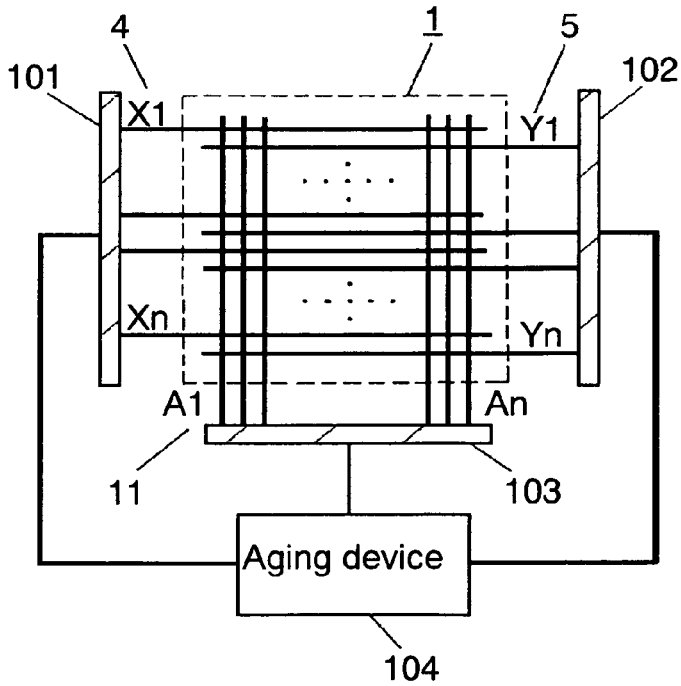
FIG. 2 is a diagram showing how the PDP connects to an aging device in an aging step in accordance with the exemplary embodiment.

FIG. 2 is a diagram showing how the PDP connects to an aging device in the aging step in accordance with the exemplary embodiment. During aging, each of scan electrodes X1 to Xn (scan electrodes 4 in FIG. 1) is short-circuited using short-circuit electrode 101 and connected to aging device 104. Similarly, each of sustain electrodes Y1 to Yn (sustain electrodes 5 in FIG. 1) is short-circuited using short-circuit electrode 102 and connected to aging device 104. Also, each of address electrodes A1 to An (address electrodes 11 in FIG. 1) is short-circuited using short-circuit electrode 103 and connected to aging device 104.

Figure 3:
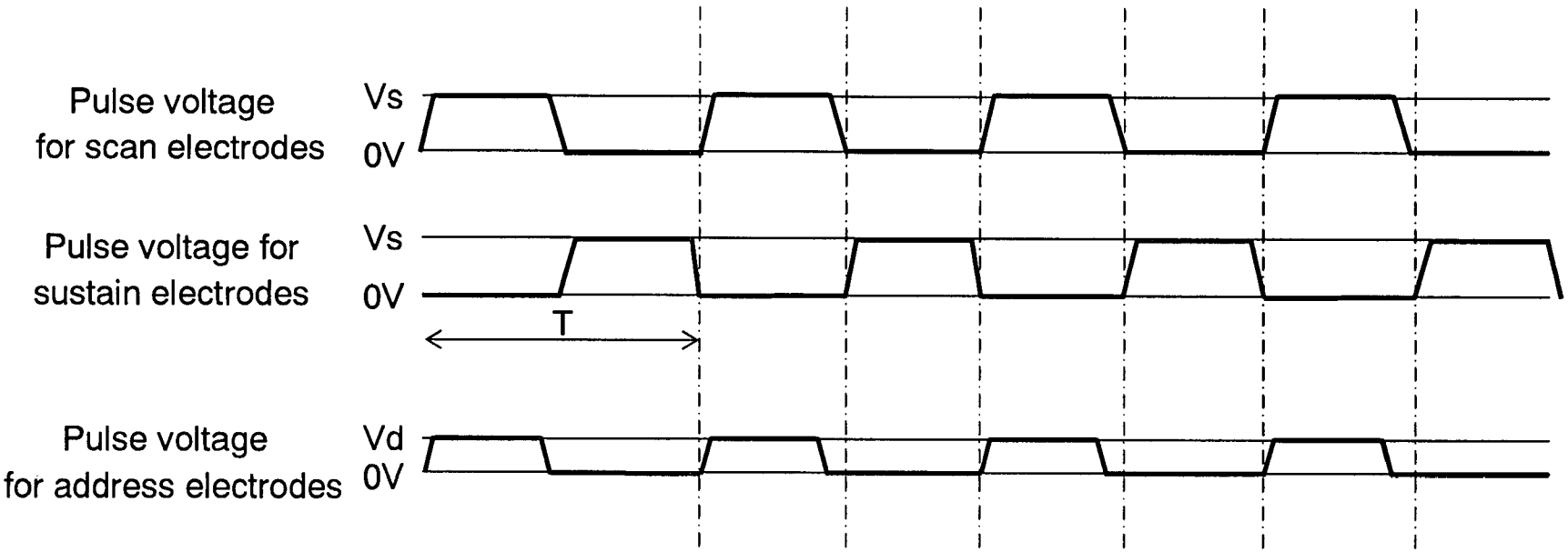
FIG. 3 is a diagram showing waveforms of pulse voltage in the method of manufacturing a PDP in accordance with the exemplary embodiment.

FIG. 3 is a diagram showing the waveforms of pulse voltage for scan electrodes applied to scan electrodes 4, pulse voltage for sustain electrodes applied to sustain electrodes 5, and pulse voltage for address electrodes applied to address electrodes 11 from aging device 104 (each hereinafter simply referred to as "pulse voltage"). Trapezoidal waves or rectangular waves at voltage Vs are alternately applied to scan electrodes 4 and sustain electrodes 5 in cycle period T, as pulse voltage. Applied to address electrodes 11 is pulse voltage of trapezoidal waves or rectangular waves each having rising edge timing synchronizing with the rising edge timing of the pulse voltage for scan electrodes and a pulse width smaller than that of the pulse voltage for scan electrodes. This is called first pulse voltage for address electrodes. Thus, the trailing edge timing of the pulse voltage applied to address electrodes 11 is earlier than the trailing edge timing of the pulse voltage applied to scan electrodes 4. Because the pulse voltage is not applied to address electrodes 11 during application of the pulse voltage to sustain electrodes 5, the pulse voltage is not applied to address electrodes 11 successively. Further, the pulse voltage for address electrodes is set to voltage Vd, which is lower than voltage Vs.

Even when pulse voltage of trapezoidal waves or rectangular waves has a rising edge timing synchronized with the rising edge timing of the pulse voltage for sustain electrodes and a pulse width smaller than that of the pulse voltage for sustain electrodes are applied to address electrodes 11, the similar result described hereinafter can be obtained. This pulse voltage is called second pulse voltage for address electrodes.

Figure 4:
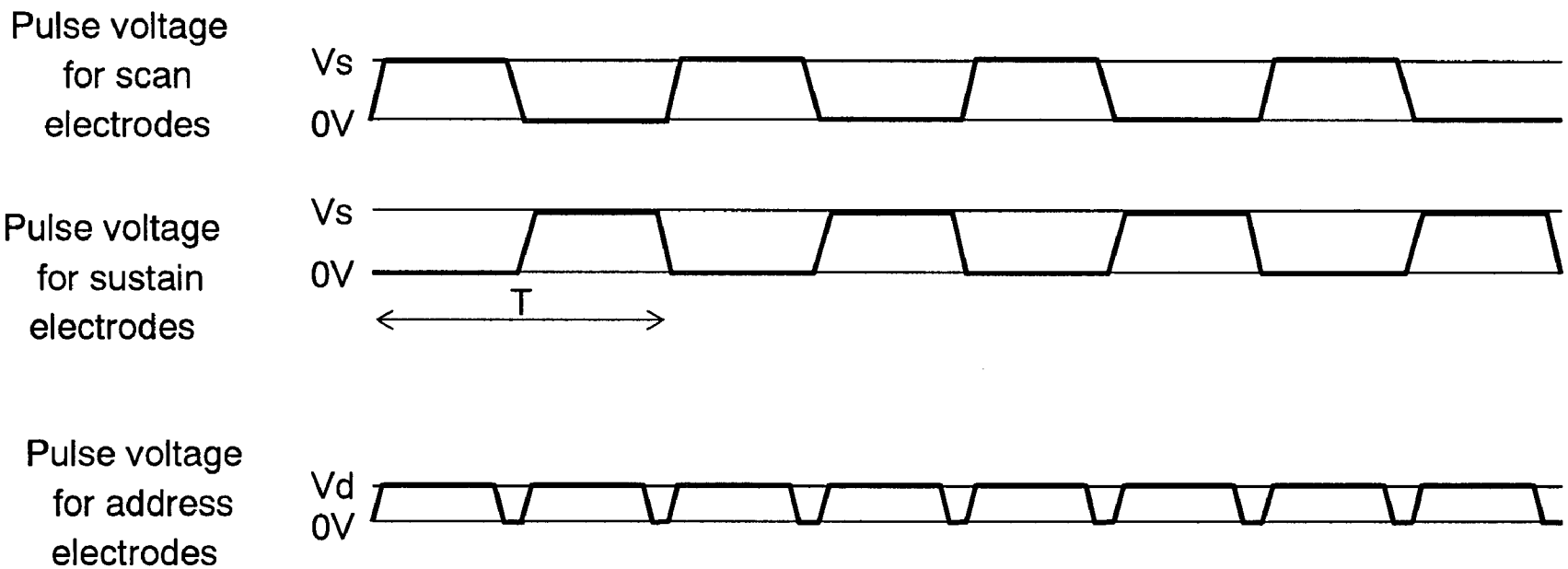
FIG. 4 is a diagram schematically showing waveforms of pulse voltage in a comparative example.

Next, the results of aging in this aging step are described. In the following description, a PDP 42 in. diagonal having pixels 1,028×768 is aged. Voltage Vs is 350V and voltage Vd is 100V, both of which are constant. Cycle period T of pulse voltage for scan electrodes and pulse voltage for sustain electrodes is 25 μs. As shown in FIG. 4, applied to the address electrodes for comparison is pulse voltage having rising edges each synchronized with the rising edges of pulse voltage for scan electrodes 4 or pulse voltage for sustain electrodes 5 and trailing edges each earlier than the trailing edges of pulse voltage for scan electrodes 4 or pulse voltage for sustain electrodes 5, i.e. successive combination of the first pulse voltage and the second pulse voltage for address electrodes. The results of this application are also discussed.

Figure 5:
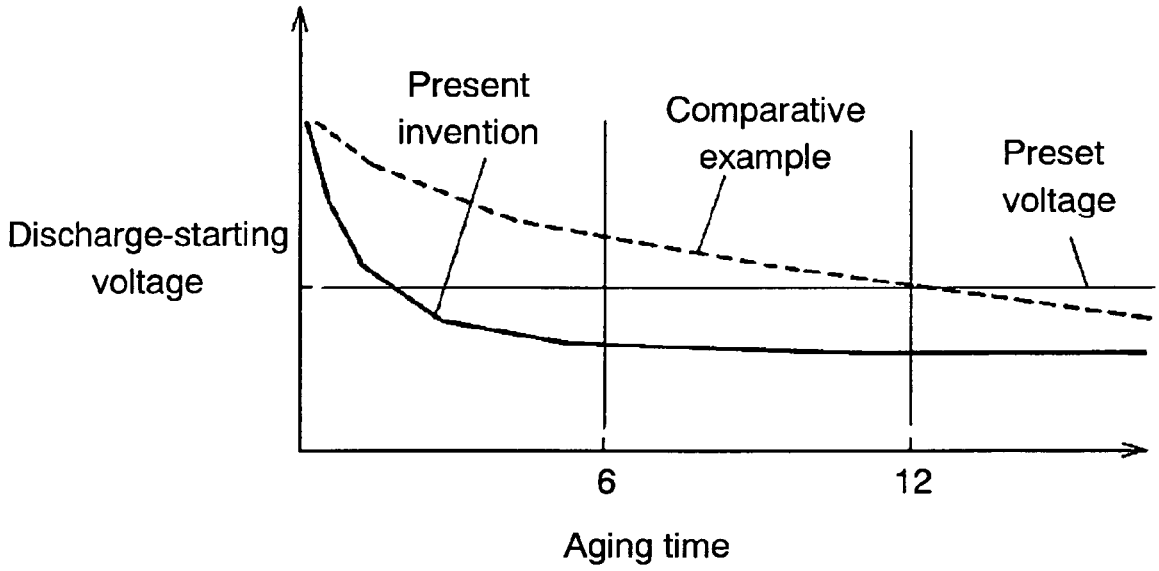
FIG. 5 is a graph showing a change in discharge-starting voltage with time in the aging step.

FIG. 5 is a graph showing a change in the lowest voltage at which aging discharge occurs in discharge cells in an aging step (hereinafter simply referred to as "discharge-starting voltage") with time. The abscissa axis shows aging time. The ordinate axis shows voltage at which discharge starts between scan electrodes 4 and sustain electrodes 5. FIG. 5 shows the results of aging at the pulse voltages of FIG. 3 and FIG. 4. Now, the point when the discharge-starting voltage decreases to a preset voltage or lower and discharge is stabilized is determined as completion of the aging step. For the aging at the pulse voltage of FIG. 4 ("comparative example" in FIG. 5), the discharge-starting voltage has not decreased sufficiently even after 12 hours and discharge is still unstable. Thus, the aging is not completed. On the other hand, for the aging at the pulse voltage of FIG. 3 ("present invention" in FIG. 5), the aging is completed in approximately six hours. As described above, the exemplary embodiment of the present invention can shorten the aging time and thus perform power-efficient aging.

The reason why the aging step in the method of manufacturing a PDP of the present invention can shorten the aging time is considered as follows.

FIGS. 6A to 6F are schematic drawings for predicting wall charges in discharge cell 16 during aging at the pulse voltage of FIG. 3. FIG. 6A shows the arrangement of wall charges immediately after aging discharge in cycle T has been completed, i.e. immediately before next cycle T of the aging discharge starts. On the side of each scan electrode 4, positive wall charges have accumulated. On the side of each sustain electrode 5, negative wall charges have accumulated. On the side of each address electrode 11, a few positive wall charges have accumulated.

With each sustain electrode 5 grounded at 0V, synchronizing pulse voltage is applied to each scan electrode 4 and each address electrode 11. While the pulse voltage increases, as shown by arrow A in FIG. 6A, electrons on the side of sustain electrode 5 are attracted by positive charges and positive electric potential on the side of address electrode 11, and thus weak discharge occurs. The electrons on the side of the sustain electrode are lighter than positive ions, and a large secondary-emission coefficient of the MgO protective layer allows the electrons to go out easily. This is also considered as the reasons for this weak discharge. This weak discharge triggers strong discharge in a region near the boundary of scan electrode 4 and sustain electrode 5. Thus, as shown by arrow B, positive ions and electrons move in opposite directions. As a result, as shown in FIG. 6B, the polarity of wall charges is reversed in the region where discharge has occurred. When the voltage applied to scan electrodes 4 is increased to Vs and the voltage applied to address electrode 11 is increased to Vd, particles generated at the initial discharge, such as charged particles, excited atoms, excited molecules, and radicals (hereinafter simply referred to as "priming particles"), trigger strong discharge in a region far from the boundary of scan electrode 4 and sustain electrode 5. Then, as shown by arrow C, electrons and positive ions move in opposite directions. Thus, as shown in FIG. 6C, the wall charges on the side of scan electrode 4 and sustain electrode 5 are reversed. As a result, negative wall charges accumulate on the side of scan electrode 4. Positive wall charges accumulate on the side of sustain electrode 5. A few negative wall charges accumulate on the side of address electrodes 11, because voltage Vd has been applied to address electrodes 11.

Next, the voltage applied to address electrodes 11 is decreased from Vd to 0V. Because the secondary-emission coefficient of a phosphor is smaller than that of the MgO, electrons are unlikely to go out. Thus, the electrons on the phosphor are unlikely to move, and thus weak discharge is unlikely to occur. Then, the voltage applied to scan electrode 4 is decreased from Vs to 0V after voltage applied to address electrodes has been decreased to 0V. At this time, because negative wall charges accumulating on the side of address electrode 11 weaken the electric field between scan electrode 4 and address electrode 11, weak discharge is unlikely to occur. Thus, discharge does not occur between scan electrode 4 and sustain electrode 5. Incidentally, the reason why the pulse voltage for scan electrodes goes down after the pulse voltage for address electrodes has gone down is that the pulse voltage for address electrodes is set so that its rising edge timing synchronizes with the rising edge timing of the pulse voltage for scan electrodes and its pulse width is smaller than that of the pulse voltage for scan electrodes.

Next, as shown in FIG. 6D, scan electrodes 4 and address electrodes 11 are set to 0V, and pulse voltage Vs is applied to sustain electrodes 5. Then, as shown by arrow D, the electrons on the side of address electrode 11 are attracted to the side of sustain electrode 5 and weak discharge occurs. This discharge triggers strong discharge in the region near the boundary of scan electrode 4 and sustain electrode 5. Thus, as shown by arrow E, positive ions and electrons move in opposite directions. As a result, as shown in FIG. 6E, the polarity of wall charges in the region where discharge has occurred is reversed. When the voltage applied to sustain electrodes 5 is increased to Vs, influence of priming particles causes strong discharge even in the region far from the boundary of scan electrode 4 and sustain electrode 5, and electrons and positive ions move in opposite directions as shown by arrow F. When the voltage applied to sustain electrodes 5 reaches Vs and discharge is completed, address electrode 11 serves as a cathode of sustain electrode 5. Thus, as shown in FIG. 6F, positive wall charges accumulate on the side of address electrode 11. Positive wall charges accumulate on scan electrode 4. Negative wall charges accumulate on sustain electrode 5.

Next, the voltage applied to sustain electrodes 5 is decreased from Vs to 0V. Then, because the secondary-emission coefficient of the MgO protective layer is large, the electrons accumulating on the side of sustain electrode are attracted by the positive charges accumulating on the side of address electrode. Thus, weak discharge occurs between sustain electrode 5 and address electrode 11, and causes discharge between scan electrode 4 and sustain electrode 5. Successively, as shown in FIG. 6A, the voltage applied to scan electrode 4 is increased to Vs and the voltage applied to the address electrode is increased to Vd. Thereafter, the wall charges change as shown in FIGS. 6B, 6C, and so on. Thus, the above-mentioned actions are repeated. In the above description, for convenience, after the application of pulse voltage Vd to the address electrode, weak discharge occurs between the sustain electrode and the address electrode in FIG. 6A. Actually, the weak discharge has occurred before the state shown in FIG. 6A, i.e. at the point shown in FIG. 6F.

Figure 7A:
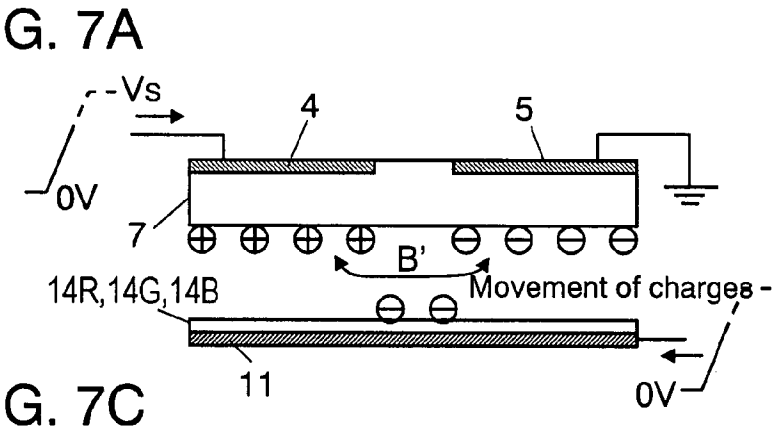
FIGS. 7A-7F are schematic drawings for predicting wall charges in a discharge cell of a PDP in the aging step of the comparative example.

FIGS. 7A to 7F are schematic drawings for predicting how wall charges move in discharge cell 16 during aging at the pulse voltage of the comparative example shown in FIG. 4. FIG. 7A shows the arrangement of wall charges immediately after aging discharge in cycle T has been completed, i.e. immediately before next cycle T of the aging discharge starts. On the side of each scan electrode 4, positive wall charges have accumulated. On the side of each sustain electrode 5, negative wall charges have accumulated. On the side of each address electrode 11, negative wall charges have accumulated, because voltage Vd has been applied during aging discharge.

Figure 7B:
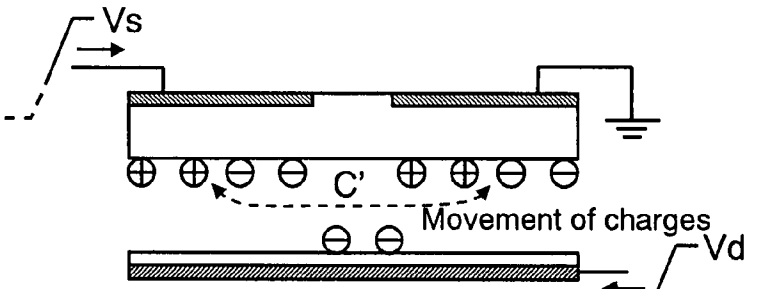
Figure 7C:
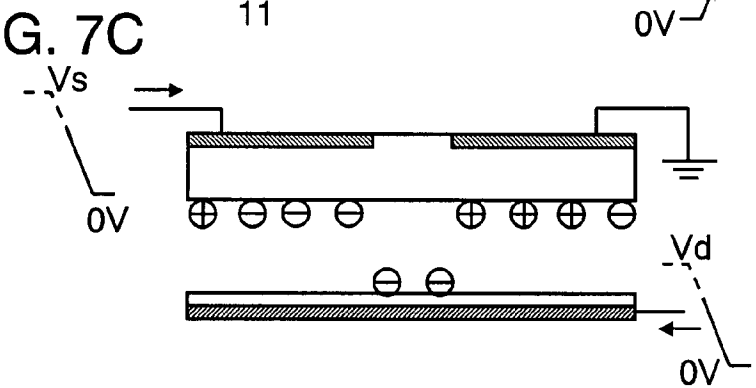

With each sustain electrode 5 grounded at 0V, synchronizing pulse voltage is applied to each scan electrode 4 and each address electrode 11. At this time, negative wall charges on the side of address electrode 11 alleviate the electric field between address electrode 11 and sustain electrode 5. For this reason, in the case of FIG. 7A, weak discharge occurring as shown by arrow A in FIG. 6A does not occur between address electrode 11 and sustain electrode 5. Then, only after the potential difference between scan electrode 4 and sustain electrode 5 has increased, strong discharge occurs in a region near the boundary of scan electrode 4 and sustain electrode 5. Thus, movement of electric charges as shown by arrow B' occurs. As a result, as shown in FIG. 7B, the polarity of wall charges is reversed in the region where discharge has occurred. When the voltage applied to scan electrodes is increased to Vs and the voltage applied to address electrodes 11 is increased to Vd, priming particles generated in the initial discharge attempts to trigger strong discharge in a region far from the boundary of scan electrode 4 and sustain electrode 5, as shown by arrow C'. However, the negative wall charges on the side of address electrode 11 inhibit the movement of the electrons, and thus this strong discharge. As a result, the discharge does not propagate in the region far from the boundary of scan electrode 4 and sustain electrode 5. Thus, the wall charges on the side of scan electrode 4 and sustain electrode 5 are only partially reversed as shown in FIG. 7C.

Figure 7D:
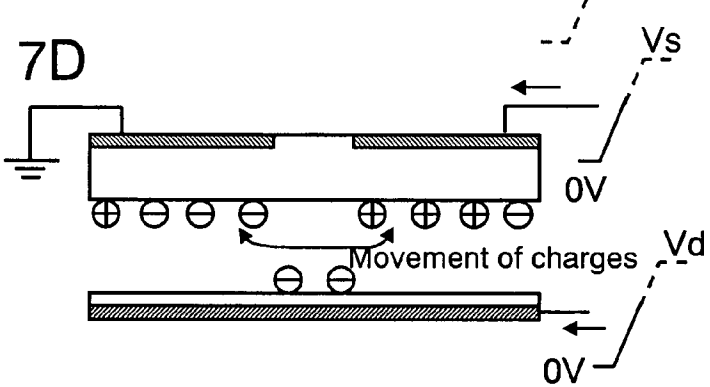
Figure 7E:
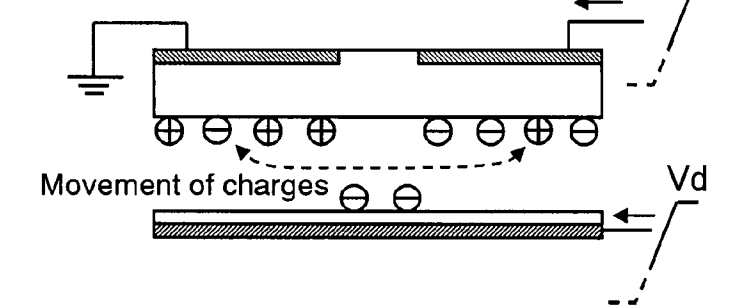
Figure 7F:
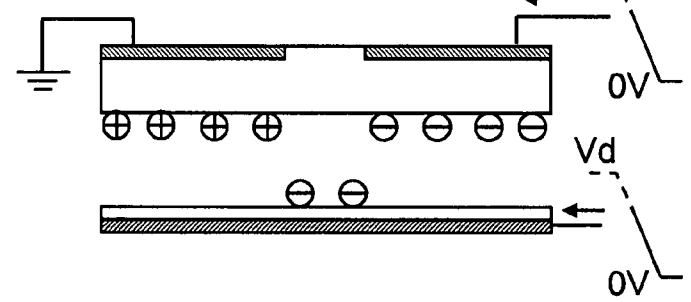

Next, with scan electrode 4 grounded at 0V, pulse voltage Vs is applied to sustain electrode 5, and pulse voltage Vd to address electrode 11. Then, the action similar to that performed when scan electrode 4 and sustain electrode 5 in FIG. 7A are reversed is performed. In other words, negative wall charges on the side of address electrode 11 alleviate the electric field between address electrode 11 and scan electrode 4. For this reason, weak discharge does not occur between address electrode 11 and scan electrode 4. Then, only after the potential difference between scan electrode 4 and sustain electrode 5 has increased, strong discharge occurs in the region near the boundary of scan electrode 4 and sustain electrode 5, as shown in FIG. 7D. Thus, movement of electric charges occurs. When the voltage applied to sustain electrodes 5 is increased to Vs and the voltage applied to address electrodes 11 is increased to Vd, strong discharge attempts to occur in the region far from the boundary of scan electrode 4 and sustain electrode 5 as shown in FIG. 7E. However, the negative wall charges on the side of address electrode 11 inhibit this strong discharge. As a result, the discharge does not propagate in the region far from the boundary of scan electrode 4 and sustain electrode 5. Thus, the wall charges on the side of scan electrode 4 and sustain electrode 5 are only partially reversed as shown in FIG. 7F.

The purpose of aging is to remove impure gases adsorbed onto the surface of protective layer 8 on scan electrodes 4 and sustain electrodes 5 by sputtering caused by discharge, decrease the discharge-starting voltage of discharge cells 16, and to stabilize the discharge. The case of FIG. 6 and the case of FIG. 7 are compared with each other from this point of view. It is considered that the electric charges move uniformly throughout a large area in a discharge cell in this exemplary embodiment, as shown in FIG. 6. However, in the case of the comparative example of FIG. 7, it is considered that the electric charges do not move sufficiently in the region far from the boundary of scan electrode 4 and sustain electrode 5. In other words, for this exemplary embodiment of the present invention, the surface of protective layer 8 on scan electrodes 4 and sustain electrodes 5 is more uniformly sputtered than that of the comparative example. As a result, the aging time of this exemplary embodiment is considered to be shorter than that of the comparative example.

Further, onto the surfaces of phosphor layers 14R, 14G, and 14B, impure gases, such as $H_2O$, $CO_2$, and hydrocarbon gas, are adsorbed. Unless these adsorbed gases are turned out by sputtering, these gases are gradually emitted into the discharge space and adsorbed onto the surface of MgO during use, and destabilize the operating voltage. In the exemplary embodiment of the present invention, the wall charges on the surfaces of phosphor layers 14R, 14G, and 14B alternately change between positive and negative, as shown FIGS. 6A to 6F. When the polarity of the wall charges changes from negative to positive, the surfaces of phosphor layers 14R, 14G, and 14B are buffeted by positive ions, and the impure gases adsorbed onto the surfaces of the phosphor layers are efficiently turned out. This is one of the factors in promptly stabilizing the operating voltage. In contrast, for the comparative example, as shown in FIGS. 7A to 7F, phosphor layers 14R, 14G, and 14B are always negatively charged, and there is no movement of electric charges. Therefore, it is considered that there are fewer chances in which positive ions buffet the phosphor layers and it takes time to stabilize the operating voltage.

As described above, it is important that two types of aging discharge are alternately repeated in an aging step. In one type of aging discharge (corresponding to FIGS. 6A, 6B, and 6C), pulse voltage is applied to scan electrodes 4 and sustain electrodes 5, and also to address electrodes 11. In the other type of aging discharge (corresponding to FIGS. 6D, 6E, and 6C), pulse voltage is not applied to address electrodes 11. These kinds of discharge allow ions to uniformly sputter the surface of MgO of protective layer 8 and buffet the surface of the phosphors, thus removing the impure gases adsorbed onto the surfaces of protective layer 8 and the phosphors. Thus, efficient aging can be performed.

Now, waveforms of pulse voltage other than that shown in FIG. 3 can also be used when one type of aging discharge in which pulse voltage for scan electrodes is applied to each scan electrode 4 and pulse voltage for sustain electrodes is applied to each sustain electrode alternately, and pulse voltage for address electrodes is not applied to each address electrode 11, and the other type of aging discharge in which pulse voltage for address electrodes is also applied to each address electrode are repeated. In other words, the waveforms include a period in which application of first pulse voltage for address electrodes to each address electrode is stopped or a period in which application of second pulse voltage for address electrodes to each address electrode is stopped. As described above, the first pulse voltage for address electrodes has a rising edge timing synchronized with the rising edge timing of the pulse voltage for scan electrodes and a pulse width smaller than the pulse width of the pulse voltage for scan electrodes can be applied to each address electrode. Alternatively, the second pulse voltage for address electrodes has a rising edge timing synchronized with the rising edge timing of the pulse voltage for sustain electrodes and a pulse width smaller than the pulse width of the pulse voltage for sustain electrodes can be applied to each address electrode. Further, when the first pulse voltage for address electrodes and the second pulse voltage for address electrodes are applied to each address electrode, the first pulse voltage for address electrodes must be applied less than four times successively or the second pulse voltage for address electrodes must be applied less than four times successively.

Figures 8A, 8B, 8C, 8D, 8E:
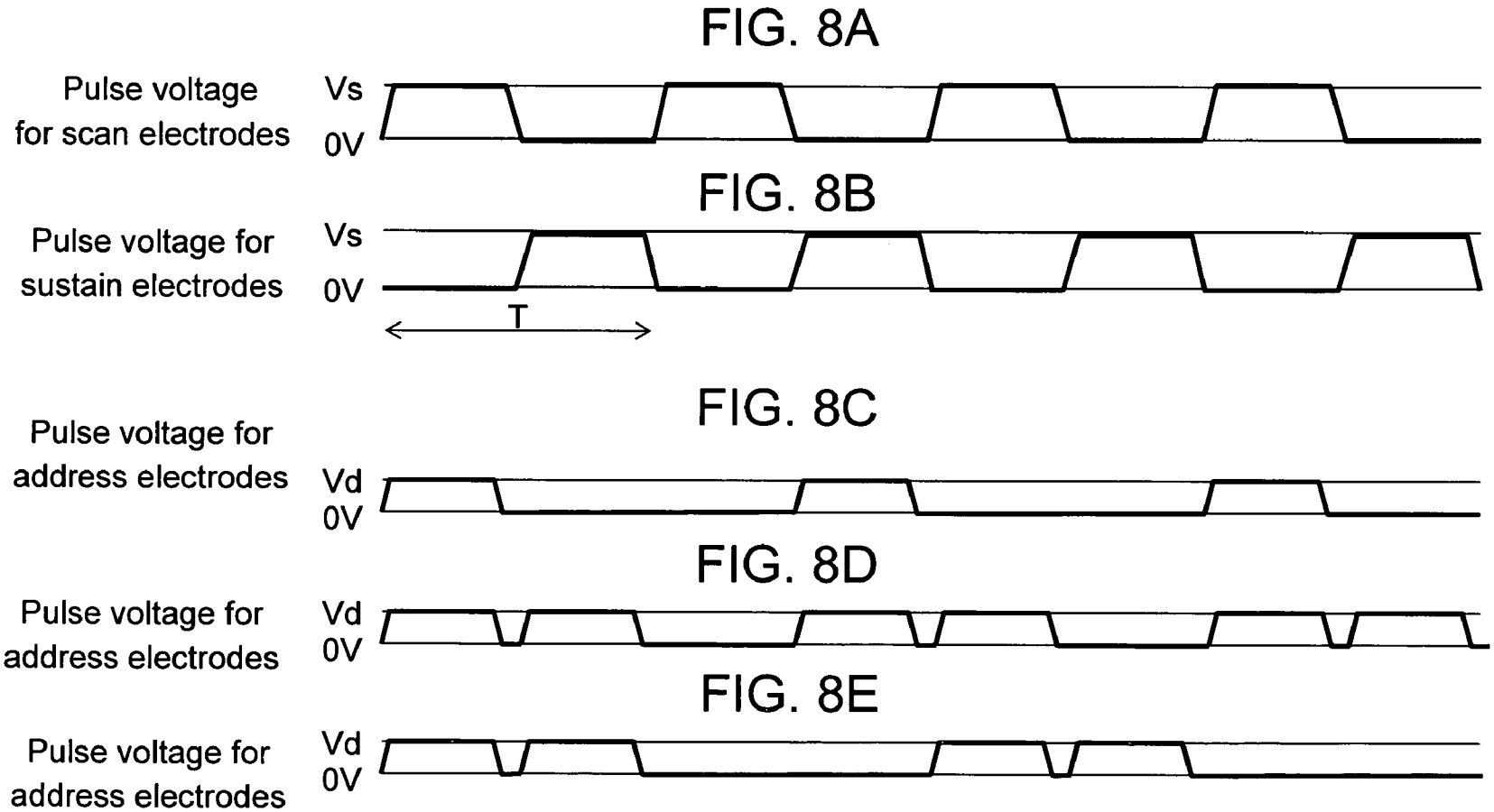
FIGS. 8A-8E are diagrams showing other waveforms of pulse voltage in a method of manufacturing a PDP in accordance with the exemplary embodiment.

FIGS. 8A-8E show other waveforms of pulse voltage in an aging step of a method of manufacturing a plasma display panel in accordance with another exemplary embodiment of the present invention. FIG. 8C shows an example in which application of pulse voltage to each address electrode 11 in synch with the rising edge of the pulse voltage applied to each scan electrode 4 and application of pulse voltage to each address electrode 11 in synch with the rising edge of the pulse voltage applied to each sustain electrode 5 are alternately repeated and a period without application of pulse voltage to each address electrode are provided twice successively. In other words, the first pulse voltage for address electrodes and the second pulse voltage for address electrodes are applied to each address electrode alternately not in succession. FIG. 8D shows an example in which pulse voltage is applied to each address electrode 11 twice successively and a period without application of pulse voltage to each address electrode is provided once. In other words, the first pulse voltage for address electrodes and the second pulse voltage for address electrodes are alternatively applied less than four times successively. FIG. 8E shows an example in which pulse voltage is applied to each address electrode 11 twice successively and a period without application of pulse voltage is provided twice successively. These pulse voltage waveforms can also provide the same effects as those described above.

Incidentally, when pulse voltage is successively applied to each address electrode, it is preferable to set the number of times up to 20. If pulse voltage is applied more than 20 times successively, the above-mentioned effects are smaller. Similarly, it is also preferable that timing in which no pulse voltage is applied is up to 20 times. If the timing is more than 20 times, the above-mentioned effects are smaller.

As for the shape of pulse voltage for address electrodes, the rising edge timing is synchronized with the rising edge timing of pulse voltage for scan electrodes or pulse voltage for sustain electrodes, and the pulse voltage for address electrodes is lowered before the trailing edge of pulse voltage for scan electrodes or pulse voltage for sustain electrodes.

Preferably, the upper limit of pulse voltage Vd for address electrodes is set not to exceed pulse voltage Vs for scan electrodes and sustain electrodes so that the pulse voltage for address electrodes does not affect the discharge between scan electrodes 4 and sustain electrodes 5. On the other hand, the lower limit of the pulse voltage for address electrodes is set to a voltage at which at least weak discharge occurs between sustain electrodes 5 and address electrodes 11. This voltage is approximately a half of the discharge-starting voltage because electric charges accumulate on the side of each electrode as shown in FIG. 6A. Incidentally, the discharge-starting voltage depends on the shape of PDP discharge cells. For a typical PDP, voltage Vd ranges from 50 to 150V.

Figure 9:
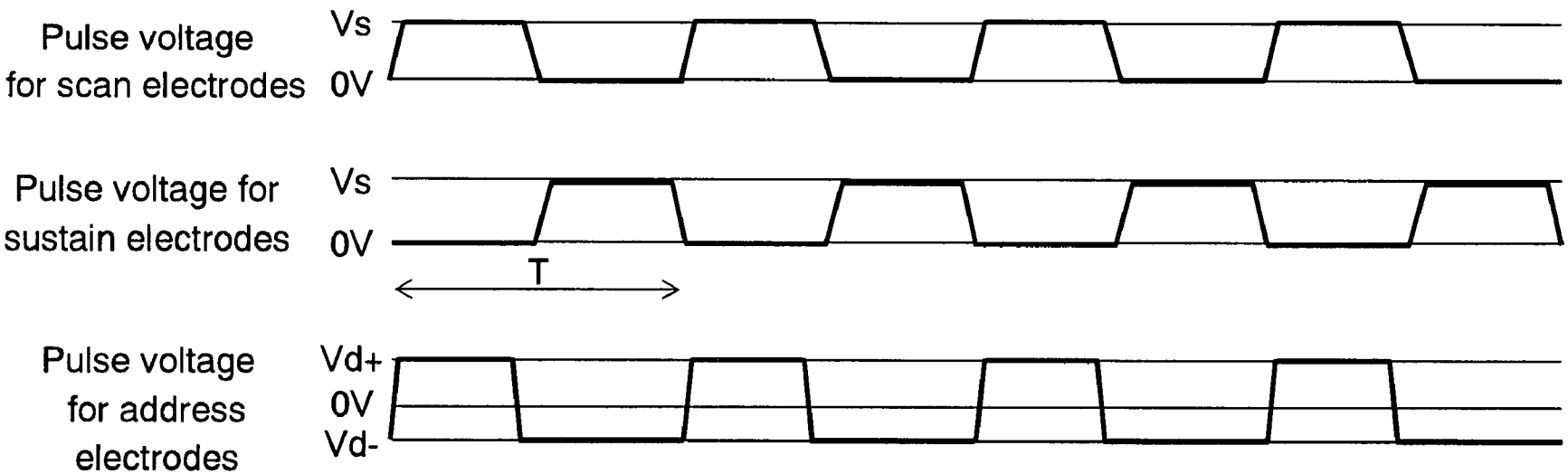
FIG. 9 is a diagram showing still another waveform of pulse voltage in a method of manufacturing a PDP in accordance with the exemplary embodiment.

Each address electrode 11 is grounded when no pulse voltage is applied thereto. However, if positive voltage Vd- is applied as shown in the example of FIG. 9, weak discharge is more likely to occur between sustain electrode 5 and address electrode 11 in the state shown in FIG. 6D. Moreover, after the discharge, more positive charges accumulate on the side of address electrode 11, and thus weak discharge is more likely to occur between sustain electrode 5 and address electrode 11 in the state shown in FIG. 6A. For this reason, application of the negative voltage is preferable. However, not to affect the discharge between scan electrode 4 and sustain electrode 5, the value of Vd must be set so that the sum of Vd+ and |Vd−| does not exceed Vs.

Figures 10A, 10B, 10C, 10D:
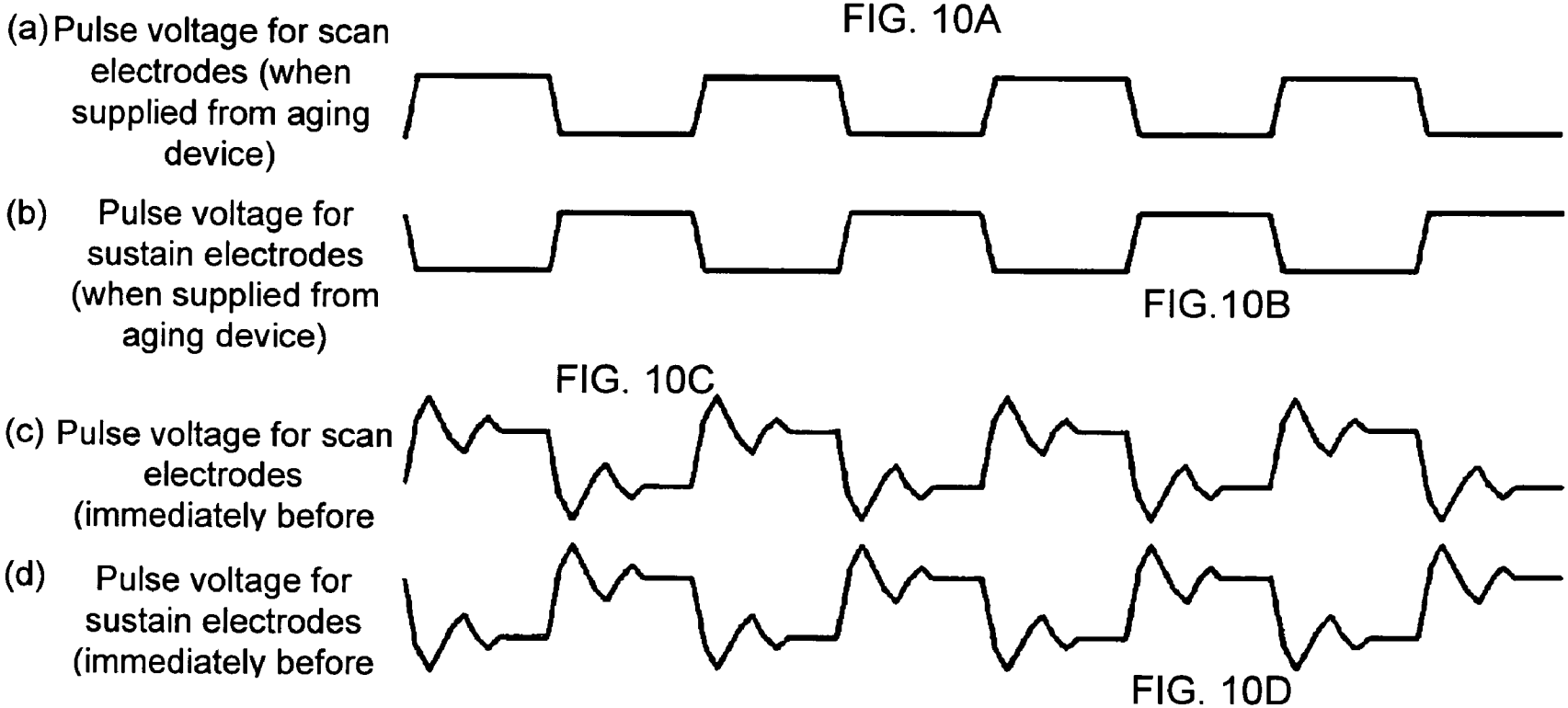
FIGS. 10A-10D are diagrams showing pulse voltage supplied from the aging device used for the method of manufacturing a PDP in accordance with the exemplary embodiment.

When inductance in wiring is minimized by shortening the wiring between aging device 104 and PDP 1 in FIG. 2, the waveforms shown in FIG. 3 are applied as almost they are. However, when an inductor is inserted between aging device 104 and PDP1 or when long wiring increases stray inductance of the wiring, resonance with the capacitance of PDP 1 adds ringing to pulse voltage. FIG. 10A shows pulse voltage for scan electrodes supplied from aging device 104. FIG. 10B shows pulse voltage for sustain electrodes supplied from aging device 104. FIG. 10C shows pulse voltage for scan electrodes in which ringing at short-circuit electrode 101 for short-circuiting scan electrodes X1 to Xn is added. FIG. 10D shows pulse voltage for sustain electrodes in which ringing at short-circuit electrode 102 for short-circuiting sustain electrodes Y1 to Yn is added. As shown in the drawings, when ringing is added to the waveform of aging voltage, the peak value of the aging voltage considerably exceeds Vs. For this reason, pulse voltage Vs at the output end of aging device 104 can be set smaller. In this case, ringing is also added to pulse voltage applied to address electrodes. However, if the ringing of pulse voltage applied to address electrodes is risen in synchronism with the rising edge of the ringing added to the waveform of pulse voltage for scan electrodes or sustain electrodes, and the waveform applied to the address electrodes is lowered in synchronism with the first trough of the ringing of pulse voltage for scan electrode or sustain electrodes, the effect of applying pulse voltage to address electrodes similar to the case of the rectangular waves can be obtained.

In the present invention, application of pulse voltage to address electrodes 11 causes weak discharge between sustain electrodes 5 or scan electrodes 4 and address electrodes 11, thus causing strong discharge between sustain electrodes 5 and scan electrodes 4. In other words, because the weak discharge triggers strong discharge between sustain electrodes 5 and scan electrodes 4, aging discharge at small pulse voltage Vs is enabled. In contrast, in a conventional aging technique, with address electrodes 11 grounded, pulse voltage is applied across scan electrodes 4 and sustain electrodes 5. In this case, because positive charges always accumulate on the side of each address electrode 11, there is no effect of decreasing Vs. In addition, high voltage Vs not only increases the power consumption required for aging, but also easily causes electrical breakdown inside of PDP 1. These problems are not preferable.

Figure 11A:
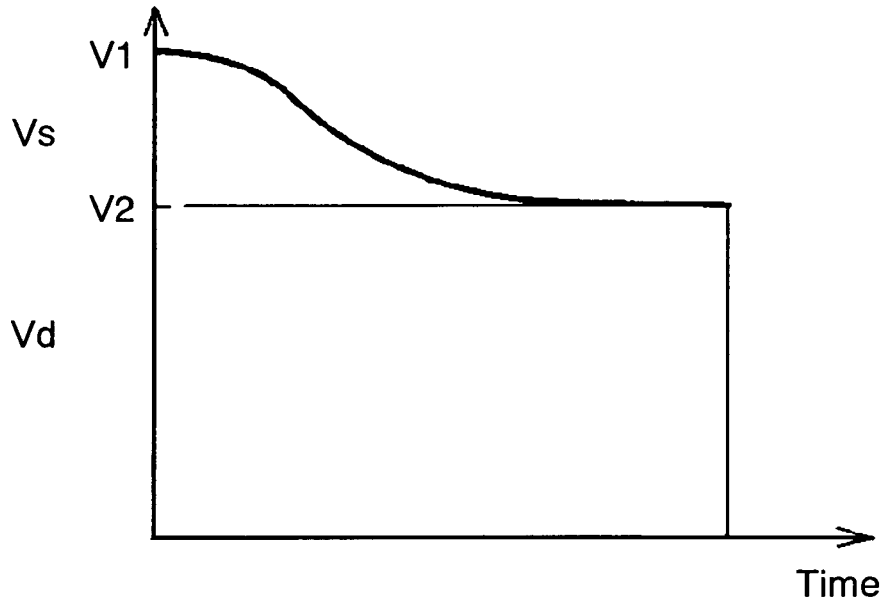
FIGS. 11A and 11B are graphs showing a change in pulse voltage with time in the aging step in accordance with the exemplary embodiment.
Figure 11B:
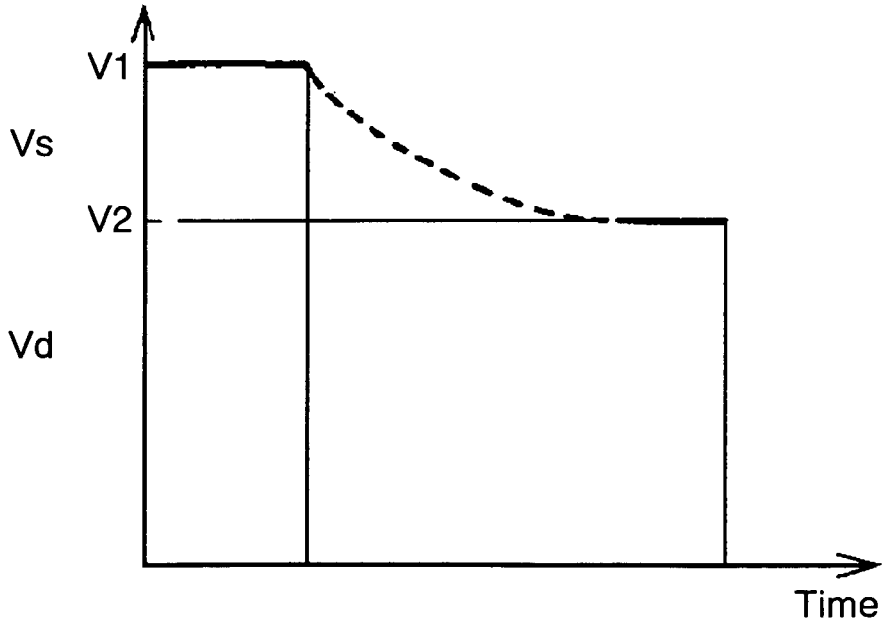

In the above structure, pulse voltage Vs applied to scan electrodes 4 and sustain electrodes 5 and Vd are constant. However, as shown in FIG. 11 as an example, if at least one of pulse voltage Vs and pulse voltage Vd is decreased as the discharge-starting voltage decreases with the progress of aging, aging power can be reduced. This reduction is more preferable. Now, FIG. 11A shows an example of a case in which voltage is continuously changed. The change can be linearly. FIG. 11B shows an example in which voltage is constant for a predetermined period of time after the start of aging and the voltage is decreased thereafter. The way of decreasing the voltage can be stepwise or gradually. As for the way of decreasing the voltage, the profile can be determined according to a change in the operating voltage during aging. At this time, when voltage Vs larger than the discharge-starting voltage is applied, dielectric breakdown is likely to occur inside of PDP 1. For this reason, it is preferable that voltage Vs is decreased according to a decrease in the discharge-starting voltage.

In the exemplary embodiment, the frequency is set to 40 kHz. However, pulses can be applied in the range of several kilohertz to 100 kHz. In addition, pulse voltages Vs and Vd can be set to appropriate values suitable for the structure of PDP 1.

The present invention can provide a method of manufacturing a PDP capable of reducing aging time and performing power-efficient aging.

As described above, the present invention can provide a method of manufacturing a PDP capable of reducing aging time and performing power-efficient aging.

The invention claimed is:

1. A method of manufacturing a plasma display panel including a scan electrode, a sustain electrode, and an address electrode, said method comprising:

short-circuiting the scan electrode, the sustain electrode and the address electrode;

applying at least one of a first pulse voltage and a second pulse voltage to the address electrode; and alternately applying a scan electrode pulse voltage and a sustain electrode pulse voltage at least across the scan electrode and the sustain electrode, wherein the first pulse voltage has a first pulse voltage rising edge timing synchronized with a scan electrode pulse voltage rising edge timing and a pulse width smaller than a width of the scan electrode pulse voltage, and the second pulse voltage has a second pulse voltage rising edge timing synchronized with a sustain electrode pulse voltage rising edge timing and a pulse width smaller than a width of the sustain electrode pulse voltage.

2. The method of manufacturing a plasma display device of claim 1 further comprising at least one of stopping application of the first pulse voltage to the address electrode for a period and stopping application of the second pulse voltage to the address electrode for a period.

3. The method of manufacturing a plasma display device of claim 2 further comprising applying the first pulse voltage less than four times successively to the address electrode and applying the second pulse voltage less than four times successively to the address electrode.

4. The method of manufacturing a plasma display device of claim 1 further comprising using values of the first pulse voltage and the second pulse voltage that are less than or equal to a scan electrode pulse voltage value and a sustain electrode pulse voltage value.

5. The method of manufacturing a plasma display device of claim 1 further comprising decreasing a value of at least one of the scan electrode pulse voltage, the sustain electrode pulse voltage, and the address electrode pulse voltage with time.

6. A method of manufacturing a plasma display panel including a scan electrode, a sustain electrode, and an address electrode, said method comprising:

short-circuiting the scan electrode, the sustain electrode and the address electrode;

causing a first discharge between the scan electrode and the address electrode, or between the sustain electrode and the address electrode; and, triggering a second discharge between the scan electrode and sustain electrode using the first discharge, by alternately applying a scan electrode pulse voltage and a sustain electrode pulse voltage at least across the scan electrode and the sustain electrode.

* * * * *